US009518458B2

(12) United States Patent
Ellithorp et al.

(10) Patent No.: US 9,518,458 B2
(45) Date of Patent: Dec. 13, 2016

(54) GAS SEPARATOR ASSEMBLY FOR GENERATING ARTIFICIAL SUMP INSIDE WELL CASING

(71) Applicants: Verley Gene Ellithorp, Ninnekah, OK (US); Brian Ellithorp, Edmond, OK (US)

(72) Inventors: Verley Gene Ellithorp, Ninnekah, OK (US); Brian Ellithorp, Edmond, OK (US)

(73) Assignee: Blackjack Production Tools, Inc., Oklahoma City, OK (US)

( * ) Notice: Subject to any disclaimer, the term of this patent is extended or adjusted under 35 U.S.C. 154(b) by 457 days.

(21) Appl. No.: 14/059,303

(22) Filed: Oct. 21, 2013

(65) Prior Publication Data

US 2014/0110133 A1 Apr. 24, 2014

Related U.S. Application Data

(60) Provisional application No. 61/795,597, filed on Oct. 22, 2012.

(51) Int. Cl.
*E21B 43/38* (2006.01)
*E21B 43/12* (2006.01)

(52) U.S. Cl.
CPC ..... *E21B 43/38* (2013.01); *E21B 43/127* (2013.01)

(58) Field of Classification Search
CPC ..... E21B 43/12; E21B 43/38; E21B 43/127
See application file for complete search history.

(56) References Cited

U.S. PATENT DOCUMENTS

| | | | | |
|---|---|---|---|---|
| 2,883,940 | A | 4/1959 | Gibson | |
| 4,676,308 | A * | 6/1987 | Chow | E21B 43/38 166/105.5 |
| 4,981,175 | A | 1/1991 | Powers | |
| 6,325,143 | B1 * | 12/2001 | Scarsdale | E21B 43/128 166/106 |
| 6,932,160 | B2 | 8/2005 | Murray et al. | |
| 7,055,595 | B2 | 6/2006 | Mack et al. | |
| 7,270,178 | B2 | 9/2007 | Selph | |
| 7,635,030 | B2 * | 12/2009 | Knight | E21B 43/38 166/106 |
| 7,736,133 | B2 * | 6/2010 | Martinez | E21B 43/128 166/105 |
| 8,141,625 | B2 * | 3/2012 | Reid | E21B 43/128 166/105.5 |

(Continued)

*Primary Examiner* — Elizabeth Gitlin
(74) *Attorney, Agent, or Firm* — Tomlinson Rust McKinstry Grable

(57) ABSTRACT

A gas separator assembly generates an artificial sump in a production casing receiving a production tubing string with a downhole pump at the bottom end thereof. The assembly includes an inner casing in series with the production casing of the well and an outer casing supported externally of the inner casing. First and second ports at opposing top and bottom ends of the outer casing communicate from a primary passage in the inner casing to a secondary passage between the inner and outer casings. A barrier supported in the primary passage between the first and second ports diverts flow through the secondary passage and effectively defines the sump area in the primary passage between an inlet of the downhole pump adjacent the barrier and the first port thereabove.

20 Claims, 2 Drawing Sheets

(56) References Cited

U.S. PATENT DOCUMENTS

| | | | | |
|---|---|---|---|---|
| 8,397,811 | B2 * | 3/2013 | Reid | E21B 43/121 166/105.5 |
| 2009/0065202 | A1 * | 3/2009 | Brown | E21B 43/38 166/267 |
| 2010/0319926 | A1 * | 12/2010 | Reid | E21B 43/128 166/372 |
| 2013/0068455 | A1 * | 3/2013 | Brown | E21B 43/121 166/265 |

* cited by examiner

PRIOR ART

GAS SEPARATOR ASSEMBLY FOR GENERATING ARTIFICIAL SUMP INSIDE WELL CASING

CROSS-REFERENCE TO RELATED APPLICATIONS

This application claims the benefit under 35 U.S.C.119(e) of U.S. provisional application Ser. No. 61/795,597, filed Oct. 22, 2012.

FIELD OF THE INVENTION

The present invention relates to a gas separator assembly and a method of preparing a well containing gas and liquid for pumping by connecting the gas separator assembly in series with the outer casing of the well when completing the well, and more particularly the present invention relates to a gas separator assembly defining a primary passage in series with the well casing for receiving a barrier therein and a secondary passage which diverts produced fluids past the barrier externally of the primary passage in series with the casing to define an artificial sump area immediately above the barrier which receives the pump therein.

BACKGROUND OF THE INVENTION

When pumping from a hydrocarbon producing well containing gas and liquid it is known to be desirable to separate the gas from the liquid in order for the pump to operate effectively. Known gas separators have various deficiencies such that gas interference, resultant gas-locking, and potential resultant damages to downhole pumping equipment, as well as downtime and deferred production is an ongoing problem.

Most horizontal wells are completed with 5.5 inch and sometimes 4.5 inch production casing strings in all current domestic gas and oil plays. This leaves roughly 4.00 to 4.75 inches to convey and operate any form of artificial lift (AL) and gas separator. There are numerous gas separation techniques used for each form of AL, but most are moderately successful at best and some do a very poor job, but may be the only option.

For reciprocating rod pump the most common form of separation is the modified poor boy gas separator. A representative diagram is attached as FIG. 1.

For electrical submersible pumps (ESP's) the most common form of gas separation in horizontal wells is the rotary gas separator. This allows the pump to expel a reasonable volume of gas to the annulus after being ingested at the intake of the pump by way of centrifugal farce. One example is disclosed in U.S. Pat. No. 4,981,175 by Conoco Inc.

For progressive cavity pumps (PCP's) the most common form of gas separation is to run either an orienting intake sub which orients the intake: ports of the tailpipe to the lowermost portion of the wellbore aiming to avoid gas intake. Also, there is a diversion type separator which redirects the flow of gas and fluids up and around the pump then dumps the fluids annularly down to the intake while the gas travels upward to the surface. One example is disclosed in U.S. Pat. No. 7,270,178 by Baker Hughes Incorporated.

The 3 AL forms listed above are 3 of the 5 most popular and widely used forms of AL in all oil and gas wells completed today. The other two are gas lift and jet pump.

The most effective form of separation in horizontal wells has come by way of a sump or an extended section off the primary production casing that is drilled post completion, often at a tangent in the curves build section typically at 30 to 60 degrees, allowing for fluids to fall to a pump set below and allowing gas to break and travel upward. This is a costly method of separation due to added drilling and completion costs and there are risks involved such as wellbore stability and integrity issues, possibility to have issues running tools into the lateral, etc.

Additional examples of gas separators are described in U.S. Pat. Nos. 6,932,160 by Murray et al, 7,055,595 by Mack et al, 4,676,308 by Chow et al, and 2,883,940 by Gibson et al. Known gas separator devices can typically have limited effectiveness while occupying large amounts of space within the interior diameter of the well casing such that insertion and removal from the well casing may be awkward and difficult, and/or limited access is provided for other downhole tools if desired.

SUMMARY OF THE INVENTION

The present invention proposes generating an artificial sump inside the existing production casing. The benefit is that in most cases no incremental drilling/completion costs will be incurred and no operational issues should be incurred as the ID of this tool will be equal to or greater than the remainder of the production casing.

According to one aspect of the invention there is provided a gas separator assembly for a use with a downhole pump supported at a bottom end of a production tubing string received within an outer casing of a hydrocarbon producing well, the assembly comprising:

an inner casing member defining a primary passage extending longitudinally therethrough between opposing first and second ends of the assembly so as to be arranged for connection in series with the outer casing of the well;

an outer casing member supported externally of the inner casing member so as to define a secondary passage extending longitudinally and externally of the primary passage between a first end and a second end of the secondary passage;

at least one first port in communication between the primary passage of the inner casing member and the secondary passage of the outer casing member adjacent the first end of the secondary passage such that the first end of the secondary passage only communicates with the primary passage through said at least one first port;

at least one second port in communication between the primary passage of the inner casing member and the secondary passage of the outer casing member adjacent the second end of the secondary passage such that the second end of the secondary passage only communicates with the primary passage through said at least one second port; and a barrier arranged to be supported in the primary passage to seal the primary passage at a location between said at least one first port and said at least one second port so as to define a sump area in the primary passage between the barrier and said at least one first port which is arranged to receive an inlet of the downhole pump therein whereby produced fluids in the outer casing below the assembly are directed from the outer casing below the assembly upwardly through the secondary passage from said at least one second port to said at least one first port and downwardly through the primary passage from said at least one first port to the inlet of the downhole pump.

Preferably the inner casing member extends substantially concentrically through the outer casing member such that the secondary passage is generally annular about the primary passage.

In other embodiments, the outer casing member may comprise one or more auxiliary tube members extending alongside the inner casing member to define the secondary passage as a plurality of longitudinally extending passages at circumferentially spaced locations about the primary passage.

Preferably an interior diameter of the primary passage is substantially equal to an interior diameter of the outer casing.

According to a second aspect of the present invention there is provided a method of preparing a hydrocarbon producing well containing gas and liquid for pumping using a downhole pump supported at a bottom end of a production tubing string, the method including:

providing a gas separator assembly comprising:

an inner casing member defining a primary passage extending longitudinally therethrough between opposing first and second ends of the assembly;

an outer casing member supported externally of the inner casing member so as to define a secondary passage extending longitudinally and externally of the primary passage between a first end and a second end of the secondary passage;

at least one first port in communication between the primary passage of the inner casing member and the secondary passage of the outer casing member adjacent the first end of the secondary passage such that the first end of the secondary passage only communicates with the primary passage through said at least one first port; and at least one second port in communication between the primary passage of the inner casing member and the secondary passage of the outer casing member adjacent the second end of the secondary passage such that the second end of the secondary passage only communicates with the primary passage through said at least one second port; and connecting the first and second ends of the assembly in series with the outer casing such that the primary passage communicates in series with a primary passage of the outer casing while completing an outer casing of the hydrocarbon producing well.

BRIEF DESCRIPTION OF THE DRAWINGS

One embodiment of the invention will now be described in conjunction with the accompanying drawings in which.

DETAILED DESCRIPTION

Figure 1:
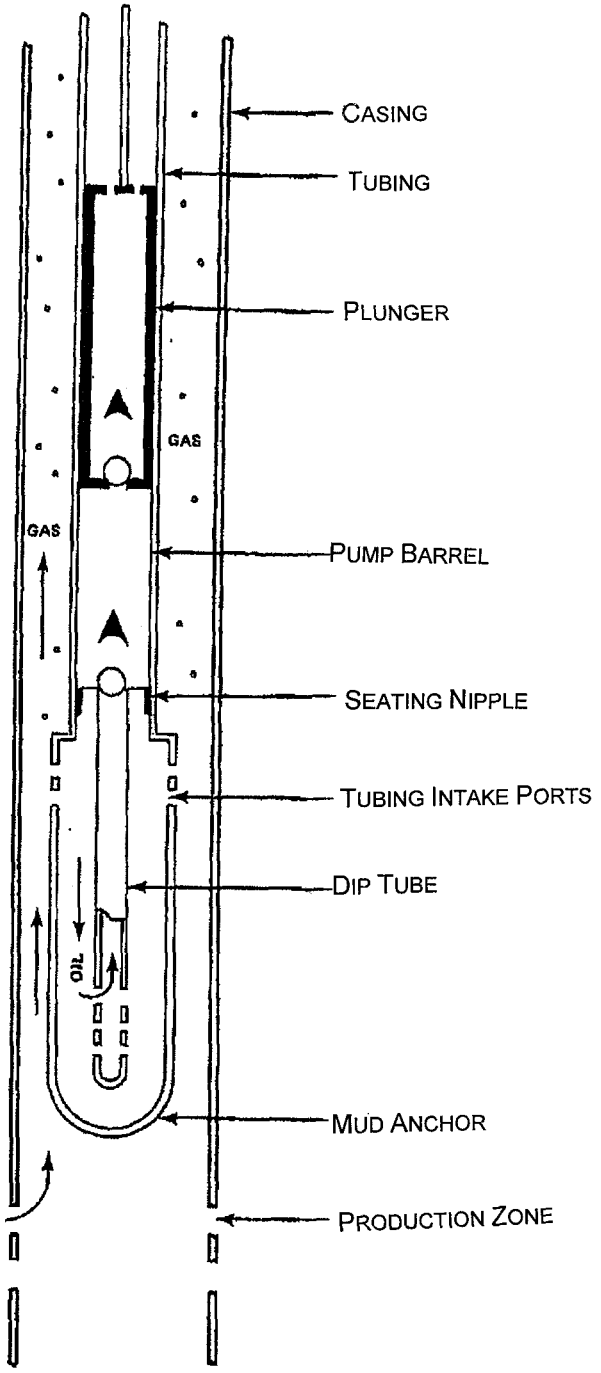
FIG. 1 is a schematic representation of a prior art gas separator known as a modified poor boy gas anchor.
Figure 2:
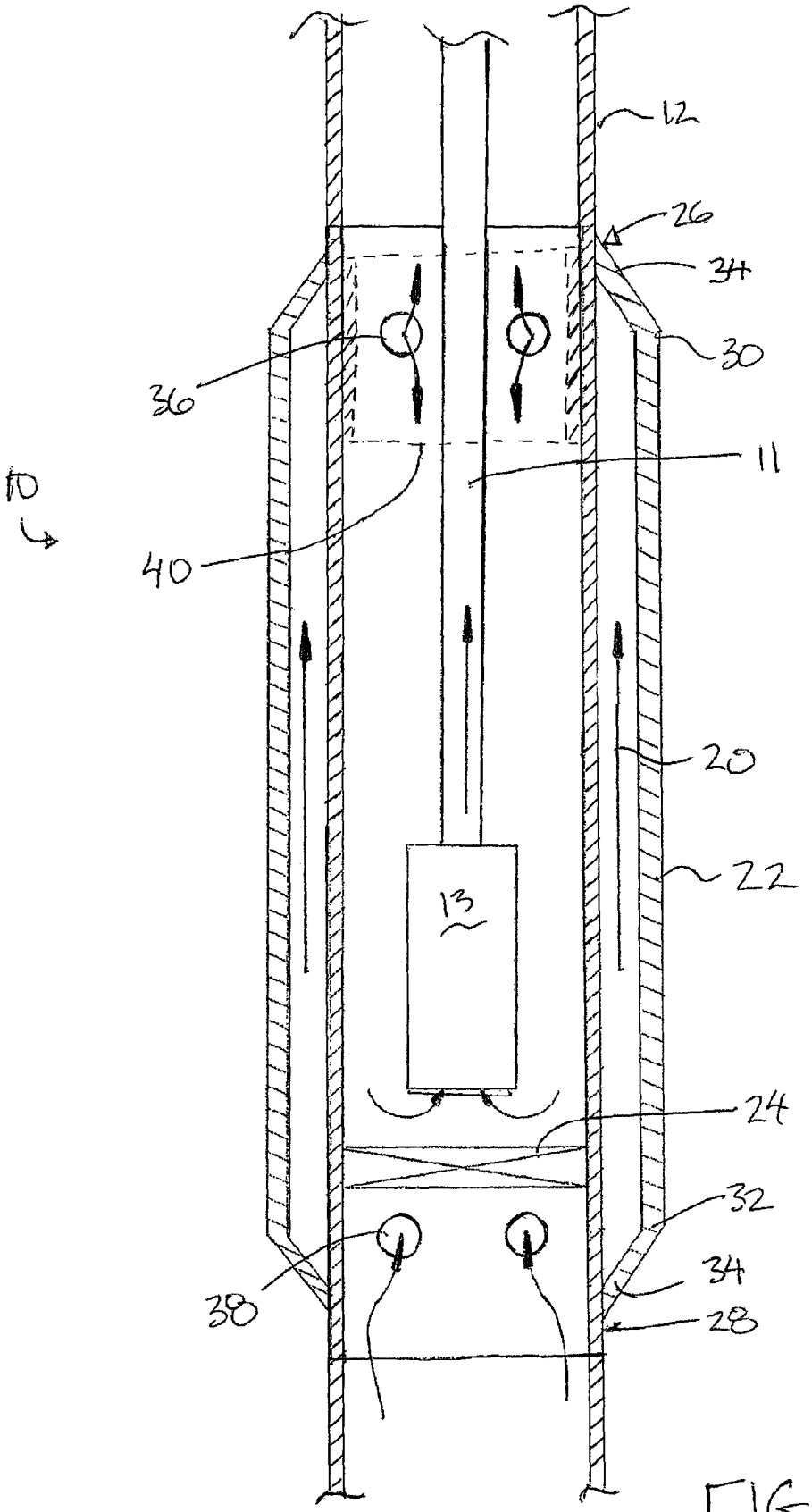
FIG. 2 is a sectional side elevational view of the gas separator assembly according to the present invention.

In the drawings like characters of reference indicate corresponding parts in the different figures.

Referring to the accompanying figures there is illustrated a gas separator assembly generally indicated by reference numeral 10. The assembly 10 is particularly suited for use with a downhole pump supported on the bottom end of a production tubing string and arranged to be received within the outer casing 12 of a well containing liquid and gas. The assembly 10 is mounted in series with the outer casing 12 of the well as the well is completed. Subsequent to completing the well with the assembly 10 mounted therein, the production tubing string 11 with the downhole pump 13 at the bottom end thereof are conveyed into the outer casing 12 and the assembly in series therewith in the usual manner of conveying production tubing into a well.

The assembly 10 generally includes an inner casing member 20, an outer casing member 22 concentrically receiving the inner casing extending longitudinally therethrough, and a barrier member 24 arranged to be received within the inner casing member to selectively seal the passage through the inner casing member as described in further detail below.

The inner casing member 20 is an elongate cylindrical tubular member which defines a primary passage extending longitudinally along the full length thereof between a top first end 26 and a bottom second end 28 of the assembly. The longitudinally opposed ends of the inner casing member at the first and second ends of the overall assembly respectively are suitably configured for connection in series with corresponding connections within the outer casing. The inner casing member is suitably sized such that the interior diameter of the primary passage extending therethrough is approximately equal to an interior diameter of the outer casing of the well.

The outer casing member 22 is similarly elongate in the longitudinal direction in the form of a cylindrical tubular member which is generally in the form of a sleeve which surrounds the inner casing member substantially along the full length thereof. The outer casing member is larger in diameter than the inner casing member so as to define a secondary passage in the annular space between the inner diameter of the outer casing member and the outer diameter of the inner casing member which spans the full length of the outer casing member in the longitudinal direction between a top first end 30 and a bottom second end 32. The first and second end each include annular end walls 34 for enclosing the respective opposing ends of the secondary passage to prevent communication of the secondary passage with the area outside of the remainder of the outer casing of the well.

A plurality of first ports 36 communicate through the wall of the inner casing member for communication between the primary passage and the secondary passage extending externally alongside the primary passage at a location in close proximity to the first end 30 of the casing members. The first ports are located at the same longitudinal position at evenly spaced apart positions in the circumferential direction. The annular end wall at the first end ensures that the first end of the secondary passage only communicates with the primary passage through the first ports 36.

Second ports 38 are similarly located in close proximity to the second ends of the casing members for communication between the primary passage and the secondary passage. The second ports 38 are similarly located at a common longitudinal position at evenly spaced apart locations in the circumferential direction. The annular end wall at the second end of the secondary passage ensures that the second end of the secondary passage only communicates with the primary passage through the second ports.

In this instance, flow of fluid up through the outer casing from a production zone below the assembly 10 enters through the primary passage at the bottom of the assembly and can flow up through the primary or secondary passages when the passages are open such that there is substantially no pressure deferential across the wall of the inner casing defining the boundary between the primary and secondary passages. As the balancing of pressure from the primary passage to the secondary passage through the ports limits any pressure deferential across the wall of the inner casing, the wall thickness of the inner casing member can be thinner than the outer casing member which has a thicker wall for containing the overall pressure within the outer casing.

A sleeve member 40 may be optionally located within the inner casing in proximity to either the first ports or the second ports. Typically, the sleeve member is mounted in proximity to the first ports so as to be more accessible. The sleeve member 40 is mounted so as to be moveable for sliding movement in the longitudinal direction of the casing between open and closed positions relative to the respective ports. When mounted for operation relative to the first ports, the communication between the primary and secondary passages through the first ports is unrestricted in the open position. In the closed position, the sleeve member is aligned with the first ports to span across the ports and maintain the ports closed, thereby preventing flow between the primary and secondary passages through the first ports. Even in the closed position of the sleeve member however, the pressure between the primary and secondary passages remains balanced by the open communication through the second ports.

The barrier member 24 is arranged to be supported in the primary passage in the form of a plug member which seals the passage closed once set. The barrier can be similar to many conventional forms of plugs for forming a seal across the passage of the outer casing and is typically set in place by various forms of downhole equipment. The barrier is set at a location directly above the second ports towards the bottom end of the assembly to define an artificial sump area within the primary passage of the inner casing member which spans longitudinally from the barrier to the first ports spaced well above the barrier adjacent the opposing top end of the assembly. The cross sectional area of the artificial sump area corresponds to the full interior diameter of the primary passage which in turn corresponds approximately to the full interior diameter of the outer casing of the well.

Once the barrier is installed and the sleeve member is located in the open position, the downhole pump can be located within the artificial sump area with the inlet of the pump preferably being located at the bottom of the pump spaced directly above the barrier at a location spaced well below the first ports. The pump may take various forms including an electrical submersible pump, a progressive cavity pump, a reciprocating rod pump, a hydraulic reciprocating pump, or a jet pump for example. In either instance, the pump is located fully above the barrier so as to be supported within the well casing independently of the barrier.

The barrier remains readily releasable and separable from the inner casing member using suitable downhole equipment to perform other wellbore operations as may be desired. When performing other wellbore operations, the sleeve member 40 is typically closed so that fluids are directed through the primary passage rather than the secondary passage.

In use, the inner and outer casing members are installed when completing the outer casing of the well. When the barrier is not installed (and the sleeve member is closed across the first ports if provided), the passage through the assembly spans substantially the full interior diameter of the inner casing member which in turn corresponds to the interior diameter of the outer casing member of the well so that the assembly has no interference with any other normal well operations within the casing.

When it is desired to produce hydrocarbons from the well which contain gas and liquid by pumping, the barrier is first placed within the primary passage between the first and second ports at a location in close proximity to the second ports and the sleeve member is opened. By locating the downhole pump directly above the barrier and spaced well below the first ports, operation of the pump causes gas and liquid flowing up from the casing below the assembly to be directed by the barrier externally of the main passage of the inner casing through the secondary passage. The flow of liquid and gas together continue to flow up the secondary passage from the second ports to the first ports where the gas and liquid then returns to the primary passage. At the first ports, the denser fluid tends to be drawn downwardly into the artificial sump area above the barrier where the inlet of the pump is located. Meanwhile, separated gas is directed primarily upwardly from the first ports through the primary passage and subsequently through the annulus of the well surrounding the production tubing string within the outer casing.

The large diameter of the artificial sump area occupying substantially the full diameter of the outer casing of the well and spanning a large height from the first ports to the barrier provides a considerable residence time for fluids to allow more gas to separate naturally within the artificial sump area before the fluid reaches the inlet of the pump at the bottom of the sump area directly above the barrier. Accordingly, substantially only liquid is drawn upwardly into the inlet at the bottom end of the downhole pump to be subsequently pumped up through the production tubing string.

According to one preferred embodiment of the present invention described above, the gas separator assembly will consist of a single joint of casing, matching the planned OD production casing. For example: 5.5" casing will accept a 5.5" casing gas separator interior string. This interior string will have either a sliding sleeve or 4 to 6 holes drilled to 1.25" diameter in a 90 or 60 degree phasing pattern. The holes or inlets of the sleeve will be spaced approximately 1.0' from the pin ends of the interior string. The casing weight of the interior string will be minimized as this section will not support any differential pressure while under operation and the reduced density will help the joint to be located with casing collar locator tools.

The connections will match that of the other planned production casing, typically LT&C.

The exterior shroud will consist of a single joint of larger OD casing such as 7" 32# to shroud the length of 5.5" interior siring. There is a 0.044" clearance between the 5.5" couplings and the ID of the 7" which will be welded, inspected, and pressure tested for integrity. Welding the outer shroud will generate a sealed outer annulus between the 5.5" and the 7".

The unit will run in on the production casing and be set at a predetermined inclination, likely at kick off point. Alternative set-points could be accommodated and would be advisable if a tangent section was drilled for the unit to be placed in. It is also a probability that more than one unit may want to be run with one at kick off and the other lower in a tangent of 60 degrees for example. This would allow for multiple setting depth options for pumping equipment over the life of the well as changing conditions would dictate.

The function of the unit would be to divert all produced gas, oil, and water into the bottom ports, through the clearance of the outer sheath and inner string, allowing fluids to dump out the top ports and down to a pump set below the top ports and above the bottom ports.

In some instances the barrier may be installed by first running a wireline set packer with a pump-out plug immediately above the bottom ports, although any other type of barrier or plug can be used. Setting immediately above the bottom ports will yield the most footage from the top ports and create the most effective and largest artificial sump possible. It is estimated that a 30 foot sump would result after installation of the packer.

The effectiveness of this type of separation is unparalleled for many reasons. The simple physics of this style diversion have proven to be very effective when put to use in systems contained within the nominal casing ID. The lighter gas travels up and the fluids fall down, plain and simple. Also, when referencing entrained gas in fluids, notably heavy oil, residence time in a separator to allow further breakout of gas is a key element. Residence time is simply the amount of time it takes to drop fluids from the upper discharge ports to the pump intake. Having the largest diameter possible via the casing ID to contain the fluids as they proceed to the intake will yield superior residence times when compared to existing gas separator systems which are fully contained within the casing and are of much smaller cross-sectional area and are typically shorter.

By retaining at least the same or larger ID as the rest of the production casing, it will be possible to pass all tools and equipment related to completions such as bits, scrapers, fishing tools, tubing, coiled tubing, TCP guns, pump down plugs, bridge plugs, etc that would be required to pass the ID of the normal production string. Further, by shrouding with a much heavier weight external shroud the desired treating pressures for the rest of the production casing would be maintained. To protect against solids and cement build-up and blockage, it may be necessary to run a sliding sleeve in the place of the open top ports to keep the casing separator's annulus clear and unobstructed. This would also help when pumping down frac plugs and other tools when the unit is set at inclination in excess of 45 degrees due to the probability of tools stalling when excess friction is seen and a lack of differential is able to be achieved if the pump down fluids are diverted to the annulus when said tools pass the open top ports and are pumped down.

The casing annulus separator described herein is typically run in when a new well is first completed.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A gas separator assembly for a use with a downhole pump supported at a bottom end of a production tubing string received within an outer casing of a hydrocarbon producing well, the assembly comprising:

an inner casing member defining a primary passage extending longitudinally therethrough between opposing first and second ends of the inner casing member, the first and second end are both connected in series with the outer casing of the well;

an outer casing member supported externally of the inner casing member so as to define a secondary passage extending longitudinally and externally of the primary passage between a first end and a second end of the secondary passage;

a first port in communication between the primary passage of the inner casing member and the secondary passage of the outer casing member adjacent the first end of the secondary passage such that the first end of the secondary passage only communicates with the primary passage through the first port;

a second port in communication between the primary passage of the inner casing member and the secondary passage of the outer casing member adjacent the second end of the secondary passage such that the second end of the secondary passage only communicates with the primary passage through the second port; and a barrier arranged to be supported in the primary passage to seal the primary passage at a location between the first port and the second port so as to define a sump area in the primary passage between the barrier and the first port which is arranged to receive an inlet of the downhole pump therein whereby produced fluids in the outer casing below the assembly are directed from the outer casing below the assembly upwardly through the secondary passage from the second port to the first port and downwardly through the primary passage from the first port to the inlet of the downhole pump.

2. The assembly according to claim 1 wherein the inner casing member extends substantially concentrically through the outer casing such that an annular space is formed between the outer casing member and the inner casing member.

3. The assembly according to claim 1 in which an interior diameter of the primary passage is substantially equal to an interior diameter of the outer casing.

4. The assembly according to claim 1 wherein the outer casing member surrounds the inner casing member and has a cross-sectional profile that is larger than that of the well casing.

5. The assembly according to claim 1 wherein the barrier is separable from the inner casing member.

6. The assembly according to claim 1 in which the downhole pump is supported fully above the barrier.

7. The assembly according to claim 1 wherein the first port and the first end of the secondary passage are in proximity to the first end of the assembly.

8. The assembly according to claim 1 wherein the second port and the second end of the secondary passage are in proximity to the second end of the assembly.

9. The assembly according to claim 1 wherein a sleeve member is supported in the inner casing member for sliding movement relative to the first port between a closed position in which communication between the first end of the secondary passage and the primary passage is prevented and an open position in which communication through the first port is unrestricted.

10. The assembly according to claim 1 comprising a plurality of first ports spaced positions about the primary passage and a plurality of second ports spaced about the primary passage.

11. The assembly according to claim 1 wherein the downhole pump comprises an electrical submersible pump.

12. The assembly according to claim 1 wherein the downhole pump comprises a progressive cavity pump or a hydraulic reciprocating pump.

13. The assembly according to claim 1 wherein the downhole pump comprises a reciprocating rod pump.

14. The assembly of claim 1 comprising a sleeve member to close the first port such that communication between the first end of the secondary passage and the primary passage is prevented and to open the first port such that communication between the first end of the secondary passage and the primary passage is permitted.

15. The assembly according to claim 1 wherein the downhole pump comprises a jet pump.

16. A method of preparing a hydrocarbon producing well containing gas and liquid for pumping using a downhole pump supported at a bottom end of a production tubing string, the method including:

providing a gas separator assembly comprising:

an inner casing member defining a primary passage extending longitudinally therethrough between opposing first and second ends of the inner casing member;

an outer casing member supported externally of the inner casing member so as to define a secondary passage extending longitudinally and externally of the primary passage between a first end and a second end of the secondary passage;

a first port in communication between the primary passage of the inner casing member and the secondary passage of the outer casing member adjacent the first end of the secondary passage such that the first end of the secondary passage only communicates with the primary passage through the first port; and a second port in communication between the primary passage of the inner casing member and the secondary passage of the outer casing member adjacent the second end of the secondary passage such that the second end of the secondary passage only communicates with the primary passage through the second port; and connecting the first and second ends of the inner casing member in series with a well casing such that the primary passage communicates in series with a secondary passage of the outer casing while completing the well casing of the hydrocarbon producing well.

17. The method according to claim 16 sealing the primary passage between the first port and the second port to define a sump area in the primary passage above the second port and below the first port.

18. The method according to claim 16 including directing produced fluids from below the assembly through the second port, up along the secondary passage, through the first port, down the pirmary passage, and up the production tubing, using the downhole pump positioned above the second port.

19. A kit, comprising:

a well casing;

an elongate inner member having opposed first and second ends for connecting the inner member to the well casing in series; wherein the well casing and inner member define a first fluid passage;

an elongate hollow outer member sized to fit around the inner member and having a cross-sectional profile that is larger than that of the well casing, wherein a second fluid passage is formed between the outer member and inner member;

a first port formed in the first end of the inner member;

a second port formed in the second end of the inner member;

a barrier positioned to seal the first fluid passage between the first port and the second port;

a pump positioned between the first port and the barrier; and a production tube, defining a third fluid passage, disposed within the inner member and operatively connected to the pump.

20. The kit of claim 19, in which the pump pulls fluid through the second port into the second fluid passage, through the first port into the first fluid passage, through the pump and pushes fluid up the production tube.

* * * * *